US005271423A

United States Patent [19]

Eychaner

[11] Patent Number: 5,271,423

[45] Date of Patent: Dec. 21, 1993

[54] COLLAPSIBLE FISH HOUSE

[75] Inventor: Clifford W. Eychaner, Grand Rapids, Minn.

[73] Assignee: Superior Products, Incorporated, Grand Rapids, Minn.

[21] Appl. No.: 950,282

[22] Filed: Sep. 24, 1992

[51] Int. Cl.[5] ..... E04H 15/06; E04H 15/30

[52] U.S. Cl. ..... 135/106; 135/107; 135/109; 135/901

[58] Field of Search ..... 135/901 R, 103, 107, 135/108, 900, 109, 88, 112, 106, 901

[56] References Cited

U.S. PATENT DOCUMENTS

Re. 31,465 12/1983 Robichaud ..... 135/88
3,581,751 6/1971 Evans ..... 135/109
4,239,247 12/1980 Hinz ..... 135/102
4,585,020 4/1986 Masuda et al. ..... 135/95

FOREIGN PATENT DOCUMENTS 2110261 6/1983 United Kingdom ..... 135/107

*Primary Examiner*—Carl D. Friedman
*Assistant Examiner*—Christopher T. Kent
*Attorney, Agent, or Firm*—John W. Adams

[57] ABSTRACT

A collapsible fish house having a pair of hinged together base sections with a flexible protective covering supported by a plurality of collapsible bow units attached at their lower ends to the base sections with the entire cover and bow structure being completely enclosed within the folded base sections when in collapsed position.

3 Claims, 2 Drawing Sheets

COLLAPSIBLE FISH HOUSE

BACKGROUND OF THE INVENTION

A number of different portable fish houses have been invented in the past, such as those disclosed in U.S. Pat. No. 4,585,020 to Masuda, et al, issued Apr. 29, 1986 and U.S. Pat. No. 4,239,247 issued to Hinz Dec. 16, 1980, as well as a number of other tents and fish houses. The concept of providing a hinged base or sled to provide a housing within which the frame and cover may be compactly stored is illustrated in the Masuda U.S. Pat. No. 4,585,020; however, neither this patent nor any of the other known prior art, provides a collapsible housing in which fishermen can stand up with room to move around.

The present invention relates to a portable fish house unit which provides a carrying housing or base unit within which the housing frame structure and flexible protective covering can be stored and transported.

SUMMARY OF THE INVENTION

The present invention provides a collapsible fish house unit having a flexible stand-up tent housing with a collapsible frame and a hinged folding base unit within which the tent housing and frame may be conveniently collapsed and confined for easy transport to the fishing location on the ice and assembled quickly and easily at the fishing site.

DETAILED DESCRIPTION OF THE PREFERRED EMBODIMENT

Figure 1:
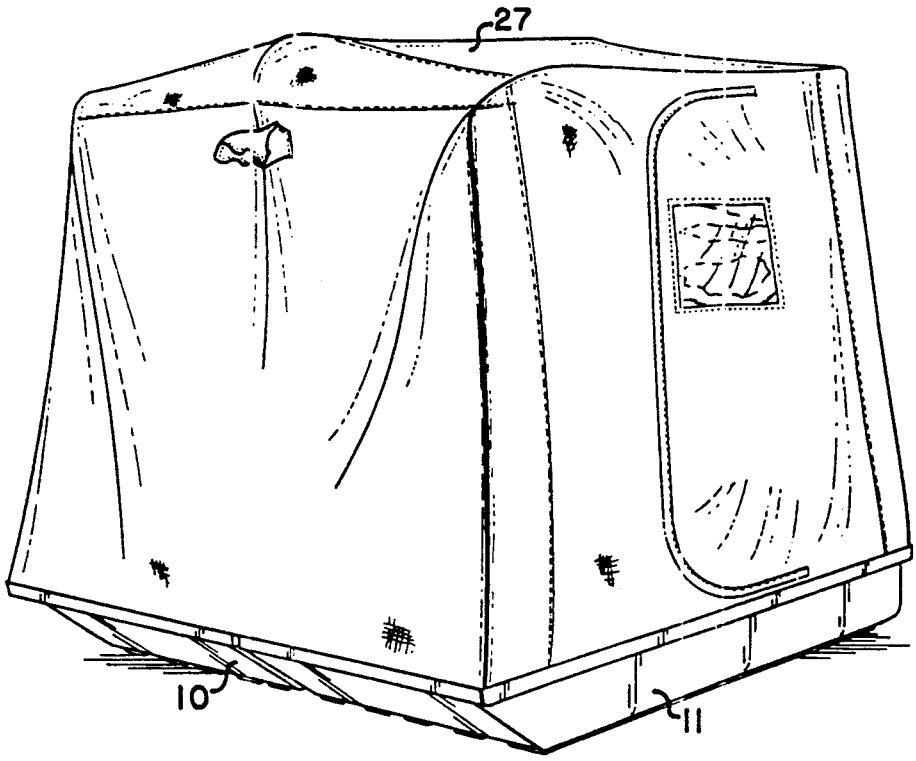
FIG. 1 is perspective view, showing the fish house in erected operative position.
Figure 2:
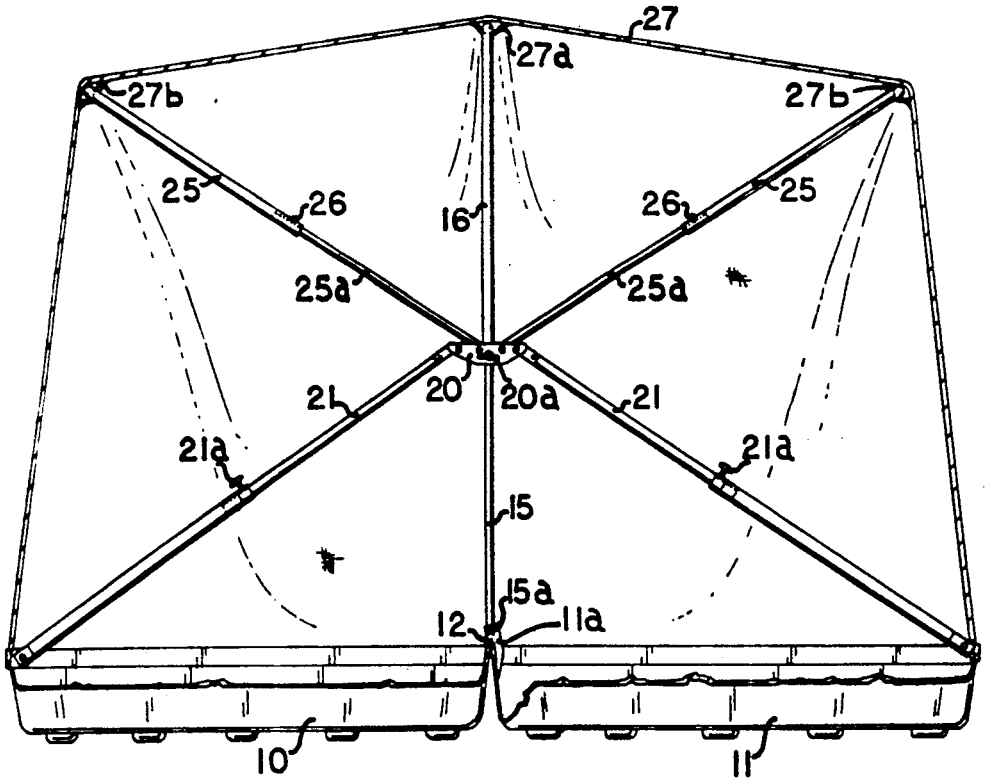
FIG. 2 is a cross sectional view thereof.

A pair of base sections 10 and 11 form a housing and have peripheral flanges 11*a* which are hinged together by a suitable hinge connector 12. A pair of center strut members 15 are respectively pivoted at their lower ends to mounting brackets 18 which are secured to the flange 10*a* of section 10 as best shown in FIG. 2. The upper ends of the center struts 15 are telescopically received in the lower portions of an upper center roof bow member 16 which permit collapsing of the bow member onto the struts 15 as will be subsequently described.

A pair of connector brackets 20 are respectively fixed to the lower ends of the center bow members 16. Lower diagonal stabilizing struts 21 are respectively pivotally connected at their upper ends to the mounting brackets 20 and at their lower ends are pivoted to the respective outer corners of the base sections 10 and 11. The struts 21 are made in two sections and are longitudinally adjustable and can be anchored by the thumb screws 21*a*.

A pair of upper diagonal bow units 25 are telescopically received on adjustable upper diagonal struts 25*a*. A resilient snap pin locking mechanism 26 is provided with a plurality of locking holes 25*b* in the members 25 for locking members 25 and 25*a* in their desired adjusted position.

A flexible protective cover 27 is made from any suitable weatherproof material such as canvas or the like and is shaped to enclose the space defined under the bow members 16 and 25 when in erected position. The upper cross members of said bow members are connected to the canvas as by suitable anchoring webs 27*a* and 27*b*.

Figure 3:
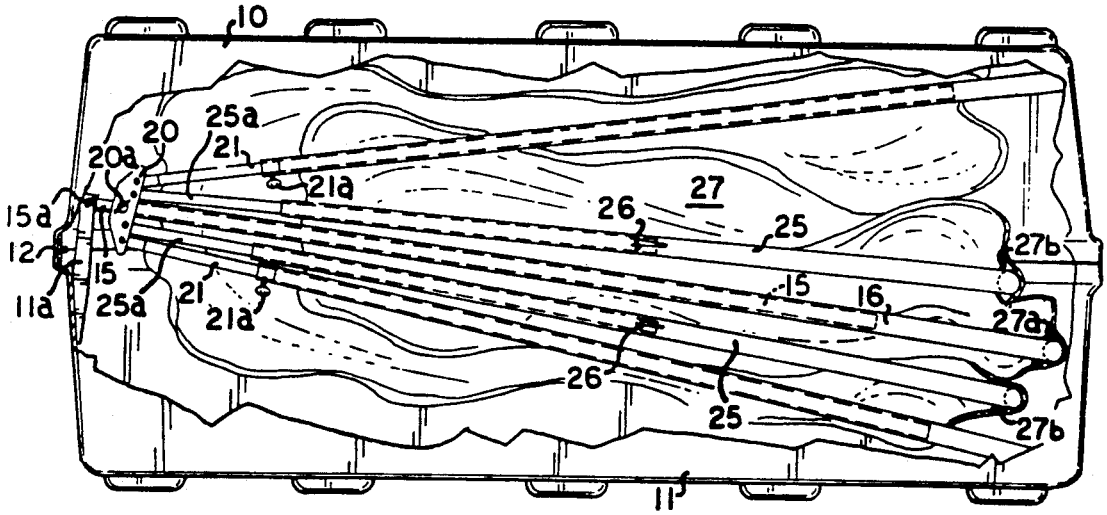
FIG. 3 is a view showing the supporting frame and protective housing in collapsed position within the carrying case with portions of the carrying case broken away; and, FIG. 4 is a fragmentary, side elevational view, with portions broken away, showing selected frame structure members.
Figure 4:
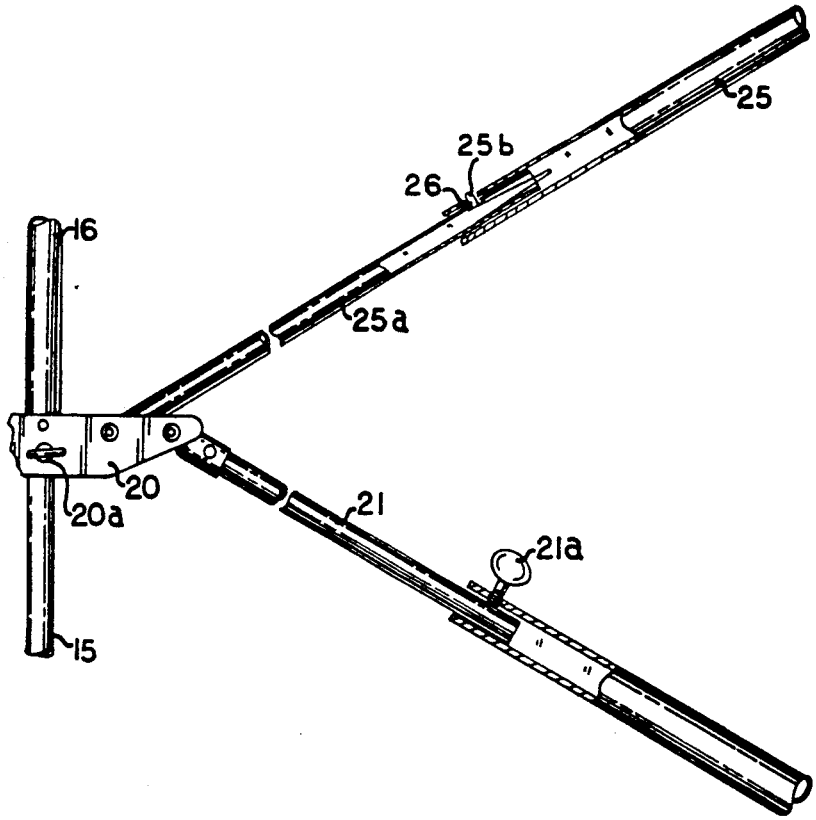

When the unit is collapsed, all of the struts are telescopically collapsed and the two connector brackets 20 are lowered into position adjacent the mounting brackets 18 The upper bow members 16 and 25 are also telescopically collapsed and carry the flexible protective covering 27 into a folded assembly which is ultimately enclosed within the base sections 10 and 11, as shown in FIG. 3.

When the frame struts are collapsed, the flexible cover is collapsed and folds into the storage area enclosed within the two base sections 10 and 11. The center strut 15 telescopically receives the larger tube 16 when the locking pin 20*a* is released so that the brackets 20 and the bottom ends of the upper strut sections 16 travel downwardly into engagement with the brackets 15*a* fixed into the base flange 11*a* of the base section 11. The left side (as viewed in FIG. 2) of the collapsed cover 27 is initially folded downwardly within the base housing section 10. When this occurs, the section 11 is raised to begin its folding operation about the center hinge connection 12 between the two sections 10 and 11. The brackets 15*a*, being fixed to the flange 11*a* of section 11, swing around through approximately 90 to position the struts 15 and 16 in substantially horizontal position along with the other struts 21 and 26, as best shown in FIG. 3. This positions the brackets 20 substantially adjacent the hinges 12, as shown in FIG. 3, with the flexible cover and strut members also collapsed and confined within the compartment formed within the closed housing sections 10 and 11. All of the pivotal connections between the lower ends of the strut members and the corners of the base sections remain fully attached when in collapsed position.

To erect the unit, the base section 10 is swung into open position. This lifts the upper frames 21 and 25 along with upper portion of the canvas covering 27 to ultimately swing the strut members around into their generally operative pre-extension orientation. When this has been accomplished, the struts 21 are fully extended and the set screws 20*a* and 21*a* are then securely locked in place. Thereafter the upper struts 25 are extended and snapped into locked position, and the fish house is thus set up and ready for use.

It will be seen that this invention provides a collapsible fish house unit which can be quickly and easily set up and taken down by one person and which will provide space for several people to be housed therein with headroom to permit standing up within by providing telescopically extensible and collapsible supporting frame structures. The entire unit can be quickly and easily collapsed into the space within the housing sections 10 and 11 for compact storage and transportation.

What is claimed is:

1. A collapsible fish house, comprising:

a pair of base sections, each of said base sections having adjacent center edge portions, said base sections being hinged together along said adjacent center edge portions, said base sections defining a housing compartment in a folded closed position and defining a base having four outer corners in an open position;

a pair of center struts having upper and lower ends, said lower ends mounted on one of said adjacent center edge portions;

a center bow frame having lower legs, each of said lower legs having a telescoping connection at the upper ends of said center struts with means for releasably locking said telescoping connection;

a pair of connector brackets respectively mounted on the lower legs of the center bow frame adapted to telescope downwardly with the bow frame legs on the respective center struts when the means for releasably locking are released;

a pair of upper diagonal corner strut and bow frame assemblies having roof supporting bow sections and lower strut elements, said roof supporting bow sections telescopically received on respective lower strut elements with means for releasably locking the lower strut elements and roof supporting bow sections in an extended position, the lower strut elements being respectively pivotally connected to the pair of connector brackets;

a pair of lower diagonal telescoping stabilizing struts having outer ends respectively pivotally connected to the four outer corners of the base sections remote from said adjacent center edge portions thereof and means for releasably locking the lower diagonal telescoping stabilizing struts in an extended position and for permitting the lower diagonal telescoping stabilizing struts to be collapsed with the center bow frame and struts adapted to fit into the housing compartment;

a flexible waterproof covering having lower outer peripheral edges anchored to the base sections adapted to enclose the space defined under the center bow frame and the upper diagonal corner struts in an erected position and provided with means for connecting the center bow frame, the upper diagonal corner strut assemblies and the lower diagonal telescoping stabilizing struts to the flexible waterproof covering, and flexible waterproof covering, said struts, said center bow frame, and said connector brackets adapted to be completely enclosed within the housing compartment defined by the base sections in the folded closed position.

2. The structure set forth in claim 1, wherein at least one of the base sections is provided with a rigid center flange hinged to the adjacent edge of the other of said pair of base sections section and extending upwardly in substantially vertical relationship when the base sections are in the open position, and the lower ends of the respective center struts having a pivotal connection with the upwardly extending center flange to facilitate folding of the said struts.

3. The structure set forth in claim 1 wherein said base sections are provided with peripheral flanges to produce a housing compartment therewithin in the folded closed position.

* * * * *